US006192809B1

(12) United States Patent
Riach et al.

(10) Patent No.: US 6,192,809 B1
(45) Date of Patent: Feb. 27, 2001

(54) COLLAPSIBLE FOLDING MASSAGE TABLE

(75) Inventors: Jeffrey M. Riach, Cockeysville, MD (US); James E. Hollingshead, Dallastown, PA (US)

(73) Assignee: Oakworks, Inc., Glen Rock, PA (US)

( * ) Notice: Subject to any disclaimer, the term of this patent is extended or adjusted under 35 U.S.C. 154(b) by 0 days.

(21) Appl. No.: 09/475,254

(22) Filed: Dec. 30, 1999

(51) Int. Cl.[7] ..... A47B 3/00
(52) U.S. Cl. ..... 108/115; 108/36; 108/169
(58) Field of Search ..... 108/36, 132, 131, 108/133, 129, 35, 169, 167, 115; 248/188.02, 188.6

(56) References Cited

U.S. PATENT DOCUMENTS

| | | | | |
|---|---|---|---|---|
| 180 | | 12/1837 | Lyford . | |
| 134,149 | | 12/1872 | King . | |
| 1,523,960 | | 1/1925 | Harbison et al. . | |
| 2,533,787 | | 12/1950 | Gebhart | 108/36 X |
| 2,618,524 | * | 11/1952 | Hoffman | 108/36 |
| 2,673,774 | | 3/1954 | Di Prima | 108/36 |
| 2,747,957 | | 5/1956 | Lencioni . | |
| 3,291,078 | | 12/1966 | De Saussure . | |
| 3,357,729 | | 12/1967 | Krueger . | |
| 4,833,998 | | 5/1989 | Everett et al. | 108/36 |
| 4,927,128 | | 5/1990 | O'Brian | 108/36 X |
| 5,009,170 | | 4/1991 | Spehar | 108/36 |
| 5,335,676 | | 8/1994 | O'Brian . | |
| 5,524,555 | | 6/1996 | Fanuzzi | 108/36 X |
| 5,913,271 | * | 6/1999 | Lloyd | 108/36 X |
| 5,943,965 | * | 8/1999 | Riach et al. | 108/36 |
| 5,974,979 | * | 11/1999 | Grady et al. | 108/36 |
| 6,000,345 | * | 12/1999 | Gillotti | 108/36 |

FOREIGN PATENT DOCUMENTS

63574 * 5/1949 (NL) ..... 108/36

OTHER PUBLICATIONS

Utility DuraTable Advertisement, Lifetime Products, Inc., Clearfield, Utah.

Utility Folding Tables Advertisement, Office Depot.

Various Folding Table Advertisment, Youngs Catalog. p. 94.

* cited by examiner

*Primary Examiner*—Jose V. Chen
(74) *Attorney, Agent, or Firm*—Nixon Peabody LLP; Charles M. Leedom, Jr.; Daniel S. Song

(57) ABSTRACT

An improved collapsible, foldable table including at least two table top sections, at least one hinge connecting the table top sections, a plurality of table legs rotatably attached to the table top sections, and a set up and rigidifying mechanism including a pair of braces, a truss member that extends from at least one of the at least two table top sections, and a central cable adapted to cause the outswinging of the plurality of table legs into an operative position when the table top sections are unfolded. Each brace includes a v-brace member, a central brace member, and a pivoting member for pivotally connecting the v-brace member to the central brace member. Preferably, the central cable extends between pivoting members of the pair of braces, a midportion of the central cable being attached to an end of the truss member. In addition, the set up and rigidifying mechanism preferably also includes a first reinforcing cable and a second reinforcing cable, the first and second reinforcing cables each extending from one table top section to the other table top section and the midportions of the first and second reinforcing cables being fixedly attached to an end of the truss member.

22 Claims, 3 Drawing Sheets

COLLAPSIBLE FOLDING MASSAGE TABLE

BACKGROUND OF THE INVENTION

1. Field of the Invention

The present invention relates to the field of collapsible, folding tables. More specifically, the invention relates to collapsible, folding massage tables with folding leg assemblies and stabilizing features that increase load capacity of the massage tables.

2. Description of Related Art

Collapsible tables with foldable leg braces are generally known and practiced in the art. These collapsible folding tables have some distinct advantages over conventional tables because they can be transported to various locations more easily and can be stored in small spaces. Such portability and small size is very important to various professional trades such as massage services where massage practitioners who visit numerous clients at various locations need specialized massage tables to provide their services. The collapsible folding massage table is often transported in the massage practitioner's vehicle from one location to another and carried and set up by the massage practitioner at the client's location. Therefore, such collapsible folding massage table must be portable, small, light weight and easy to set up and collapse.

One of the disadvantages of such collapsible, folding table is that it is not as strong or structurally stable as a conventional table. The joints and hinges used to allow the table to be collapsible and foldable also decrease the structural rigidity of the table and diminish the table's strength and stability. This weakness and instability is especially problematic for a massage table because clients lay on the table surface when the massage practitioner provides his or her services. Thus, if the table collapses or if the table is unstable, the client will fall off the table and will likely to be injured. Consequently, the collapsible table must also have high strength, rigidity and stability so that it will not collapse during use.

In addition, to facilitate their use, massage tables having mechanisms that automatically erect the legs of the table as the table is unfolded has been also created. For example, U.S. Pat. No. 4,833,998 to Everett et al. discloses a collapsible massage table with two table top sections that are hingedly connected and two pairs of legs hingedly connected to the table top sections. Each leg is supported by a foldable leg brace having two brace members hingably connected together, an end of the first brace member being attached to the leg and an end of the second brace member being attached to a table top section. The table disclosed also includes cable leg which extends downwardly from a table top section and a pair of cables interconnecting the upper corners of the table top section via the cable leg. However, because the foldable leg braces and their components are typically made of a heavy rigid material, it has been found that Everett's tables are relatively heavy thereby diminishing their portability. In addition, it has been found that Everett's tables are relatively expensive because of the amount of materials used in the numerous foldable leg braces and because of the associated costs of assembling these leg braces and attaching them to the massage table. Furthermore, while providing adequate support for light loads, this table design has been found to be inadequate for supporting very heavy loads unless the brace members are made even more robust which has the disadvantage of further increasing costs and weight.

Moreover, it has been found that the foldable leg braces, the pair of cables as well as the cable leg provided in the Everett table all limit access underneath the massage table when the massage table is unfolded. In particular, because these components extend substantially up to the peripheral edges of the table top sections, massage practitioners cannot use the space underneath the table top sections when such use is desirable. For instance, in certain circumstances, it may be desirable for the massage practitioner to place his/her leg, thigh and/or foot underneath the table in order to attain a stance which will allow exertion of additional force for proper massaging of the client laying on the table surface. In another instance, the massage practitioner may want to sit down on a chair or a small stool with his/her knees underneath the table so that a light massage may be given without tiring the legs massage practitioner. Because the foldable leg braces, the pair of cables as well as the cable leg all limit access underneath the massage table, the massage practitioner cannot attain such positions and cannot properly massage the client when such prior art tables are used. Thus, the above noted disadvantages of this and other conventionally designed massage tables diminish their appeal and utility.

An alternative massage table design is shown in U.S. Pat. No. 5,335,676 to O'Brien where sliding cables are used to erect the table legs when the massage table is unfolded and also to support the table legs under load. The table disclosed includes a v-shaped truss which support the sliding cables and improve accessibility to the space underneath the midportion of the massage table in the region where the two table top sections are hinged. However, the table still includes a set of first cables that extend from a midportion of the legs to the tip of the truss that substantially impede accessibility to the space underneath the massage table in other regions of the table such as underneath each of the two table top sections themselves. Moreover, it has been found that the numerous sliding cables in the table in accordance with O'Brien stretch under load thereby causing the table to be unstable. This stretching of cables has been found to be even more pronounced under high loads thereby rendering O'Brien's table inadequate for supporting large loads such as the weight of a person. Thus, similar to the other prior art massage tables, the limitations in stability and load carrying capacity as well as limited accessibility to the space underneath the massage table diminishes the O'Brien table's appeal and utility.

Therefore, there is a substantial and unfulfilled need for an improved collapsible, folding massage table which is easy to set up and collapse. There is also an unfulfilled need for such an improved collapsible folding massage table with reduced weight and reduced cost. In addition, there is an unfulfilled need for an improved collapsible folding massage table which is rigid and stable, even under heavy loads. Lastly, there is also an unfulfilled need for such an improved collapsible folding massage table which provides improved accessibility to the space underneath the massage table.

SUMMARY OF THE INVENTION

In view of the foregoing, it is an object of the present invention to provide an improved collapsible foldable table that is easy to set up and collapse.

A second object of the present invention is to provide an improved collapsible foldable table with reduced weight and reduced cost.

Another object of the present invention is to provide an improved collapsible foldable table that is structurally rigid and stable, even under heavy loads.

Yet another object of the present invention is to provide an improved collapsible foldable table which provides improved accessibility to the space underneath the massage table.

In accordance with one embodiment of the present invention, these and other objects are obtained by a collapsible, foldable table including at least two table top sections, at least one hinge connecting the table top sections to allow the table top sections to be moved between a working configuration where the table top sections are co-planar and a collapsed configuration where the table top sections are folded into a substantially parallel orientation, a plurality of table legs rotatably attached to the table top sections, and a set up and rigidifying means for outswinging the plurality of table legs into an extended position as the table top sections are unfolded and for maintaining the table top sections in their co-planar position even when subjected to substantial forces. The set up and rigidifying means includes a pair of bracing means for supporting the plurality of table legs in their extended position when the pair of bracing means are moved to an operative position, at least one of the pair of bracing means including a brace member, a central brace member, and a pivoting means for pivotally connecting the v-brace member to the central brace member. The set up and rigidifying means also includes a central cable extending between the pair of bracing means, the central cable being adapted to cause the outswinging of the plurality of table legs into an extended position when the table top sections are unfolded.

In one preferred embodiment of the collapsible, foldable table, both bracing means includes a v-brace member, a central brace member, and a pivoting means for pivotally connecting the v-brace member to the central brace member. The v-brace member may be hingably attached to at least two table legs and the central brace member may be hingably attached to one of the table top sections. In this embodiment, the central cable may extend between the pivoting means of the pair of bracing means. In addition, the central cable may extend from the pivoting means to the table top sections thereby preventing over displacement of the pivoting means. Moreover, the pivoting means for each of the pair of bracing means may be a molded pivoting member adapted to be affixed to an end of the central brace member, the pivoting means also having a through hole sized to receive the v-brace member. Of course, in other embodiments, the pivoting means may alternatively include a hinge pin that hinges the central brace member and the v-brace member together.

In yet another embodiment of the collapsible, foldable table in accordance with the present invention, the set up and rigidifying means may further include a truss member that extends from at least one of the at least two table top sections, a midportion of the central cable being attached to an end of the truss member. Additionally, in this embodiment, the set up and rigidifying means may further include a first reinforcing cable and a second reinforcing cable, the first and second reinforcing cables each extending from one table top section to the other table top section and the midportions of the first and second reinforcing cables being fixedly attached to an end of the truss member.

In another embodiment of the present invention, the at least one hinge connecting the table top sections may include an integral brace attaching means for hingably attaching the central brace member. In this regard, the at least one hinge may include a plurality of brackets for attachment to the table top sections, the plurality of brackets being hingably joined together to allow the table top sections to be pivoted relative to one another. The at least one hinge may also include a receiving means integrally formed from at least one of the plurality of brackets for receiving and hingably attaching an end of the central brace member.

Similarly, in yet another embodiment, the at least one hinge connecting the table top sections may include an integral truss attaching means for hingably attaching the truss member. The at least one hinge may include a plurality of brackets for attachment to the table top sections, the plurality of brackets being hingably joined together to allow the table top sections to be pivoted relative to one another. The at least one hinge may also include a receiving means integrally formed from at least one of the plurality of brackets for receiving and hingably attaching an end of the truss member.

These and other objects, features and advantages of the present invention will become more apparent from the following detailed description of the preferred embodiments of the invention when viewed in conjunction with the accompanying drawings.

DETAILED DESCRIPTION OF THE PREFERRED EMBODIMENTS

Figure 1:
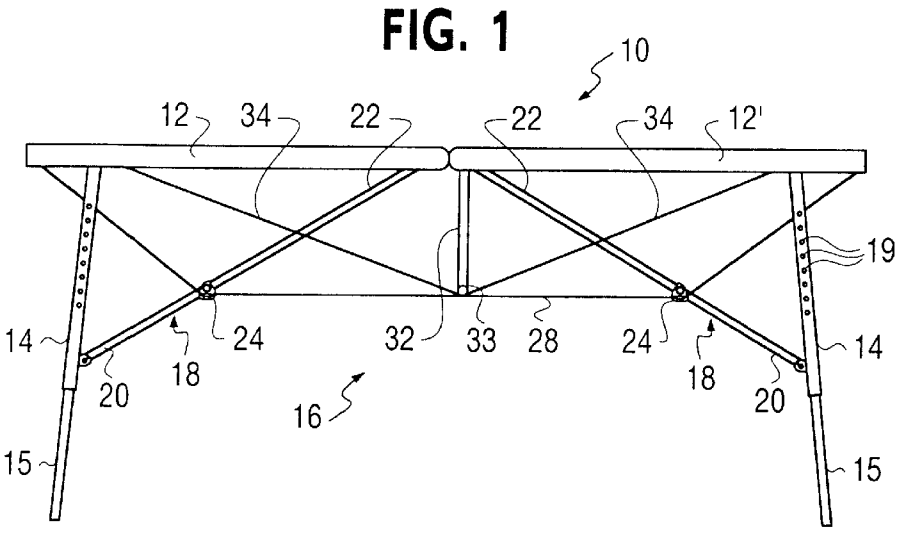
FIG. 1 is a perspective view of a massage table in accordance to one embodiment of the present invention.

FIG. 1 illustrates one embodiment of an improved collapsible, folding massage table 10 in accordance with the present invention which is easy to set up and collapse. As will be discussed herein below, the massage table 10 provides significant reduction in weight and cost over prior art massage tables while providing rigid and stable massage surface, even under heavy loads. Moreover, the massage table 10 provides significantly improved accessibility to the space underneath the massage table 10 as compared to prior art massage tables thus improving the utility and desirability of the massage table 10.

Figure 2:
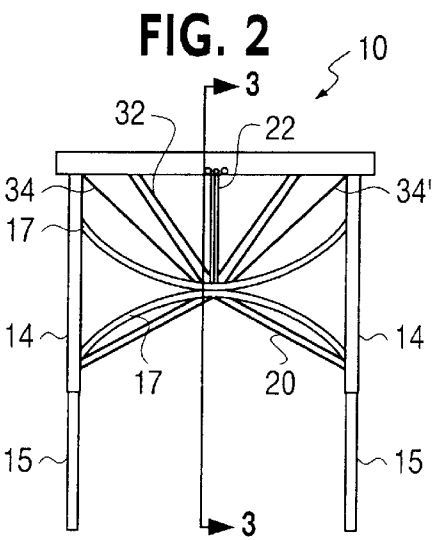
FIG. 2 is a side view of the massage table shown in FIG. 1.

As can be seen, FIGS. 1 and 2 illustrates a massage table 10 in accordance to the preferred embodiment of the present invention that includes a pair of hingedly-connected table top sections 12 and 12', illustrated in their operative co-planar position, and four substantially identical table legs 14 (only two being shown) which are pivotally connected adjacent each of the four outer corners of the table top sections 12 and 12'. The massage table 10 is further provided with an automatic set up and rigidifying mechanism 16 for outswinging all four table legs 14 into operative extended positions as the table top sections 12 and 12' are unfolded into their the co-planar position illustrated. In addition to simplifying set up, the automatic set up and rigidifying mechanism 16 further automatically actuates a unique undergirding system of braces, a truss and cables to maintain the table top sections 12 and 12' in their co-planar operative position, even when subjected to loading and forces that would cause sagging or even failure in more conventional folding table designs. Moreover, the massage table 10 in accordance with the present invention provides significantly improved accessibility to the space underneath the massage table 10 as compared to prior art massage tables thereby significantly improving the utility and desirability of the massage table 10.

Figure 3:
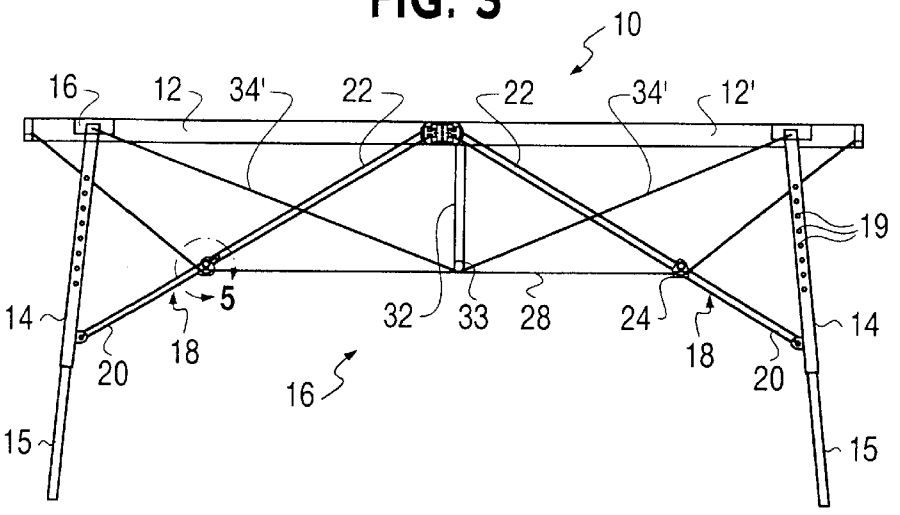
FIG. 3 is a cross-sectional view of the massage table shown in FIG. 2 as viewed along 3—3.

As can be more easily seen in FIG. 3 which is a cross-sectional view of the massage table 10, each table leg 14 is rotatably attached to one of the outer comers of a table top sections 12 and 12' via a leg block 16 or other appropriate table structure. The pair of table legs 14 which are rotatably attached to the same table top section further support one another by cross members 17 which provide lateral strength and stability to the legs. Furthermore, the table legs 14 of the embodiment shown in FIGS. 1 and 3 are adjustable type so that the heights of the table top sections 12 and 12' may be adjusted. In this regard, the table legs 14 may be made of an adjustable leg member 15 that can be used to raise the standing height of the massage table 10 by aligning the alignment holes 19 and setting the position with a retaining pin (not shown). Whereas in the illustrated embodiment, these table legs 14 (including the adjustable leg member 15) and the cross members 17 are made of aluminum tubes, these components may also be made of wood, composites, plastics and/or other sufficiently strong, and preferably light weight material, in any combination.

The table legs 14 of the massage table 10 in accordance with the present invention are further supported by a pair of braces 18 which support the table legs 14 when the pair of braces 18 are moved to an operative position. Each of the braces 18 includes a v-brace member 20, a central brace member 22, and a pivoting member 24, the brace members being more clearly shown in FIG. 4. The central brace member 22 is hingably attached at one end to the underside of a table top section and pivotally attached at the other end to a radially angled corner end 21 of the v-brace member 20 via the pivoting member 24. The central brace member 22 may be attached to the underside of a table top sections 12 and 12' in the manner discussed in further detail below. The v-brace member 20 is also hingably attached to two table legs 14 which are attached to the same table top section thereby further providing lateral reinforcement and support for the table legs 14 and correspondingly, the massage table 10.

Figure 5:
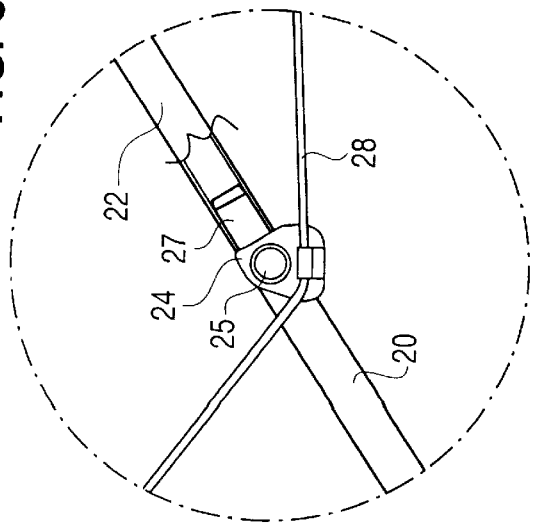
FIG. 5 is an enlarged view of Area 5 of the massage table shown in FIG. 3.

As can be seen, the v-brace members 20 converge such that the radially angled corner end 21 is positioned at the center midportion of the table top sections 12 and 12' and substantially align with a longitudinal axis LA of the massage table 10. The pivoting member 24 which is more clearly illustrated in the enlarged view of FIG. 5, is provided at the radially angled comer end 21 to pivotally attach the central brace member 22 to the v-brace member 20. As can be appreciated, the automatic set up and rigidifying mechanism 16 in accordance with the present invention eliminates an extra brace member used in prior art massage tables thereby decreasing weight and cost of the massage table 10. At the same time, the massage table 10 in accordance with the present invention maintains the structurally rigid brace members to avoid the limitations and cable stretching problems of prior art all cable systems.

In addition, as can also be seen, the v-brace members 20 allow the central brace members 22 to be centrally attached to the underside of the table top sections 12 and 12' in a substantial alignment with the longitudinal axis LA which is positioned away from the edges 26 of the massage table 10 thereby providing the massage practitioner significantly improved accessibility to the space underneath the massage table 10 as compared to prior art massage tables. Since there are no rigid brace members proximate to the edges 26 in the midportions of the massage table 10 when the massage table 10 is unfolded into an operative configuration, the massage practitioner can use the space underneath the massage table 10 to provide improved massage services thereby improving the utility and desirability of the massage table 10. In particular, the massage table 10 in accordance with the present invention allows the massage practitioner to place his/her leg, thigh and/or foot underneath the table in order to attain a proper stance for performing certain massage techniques and also allows the massage practitioner to sit down on a chair or a small stool with his/her knees underneath the massage table 10.

In this embodiment, the central brace member 22 and the v-brace member 20 are made from aluminum tubes. However, it should be appreciated that these components may also be made of wood, composites, plastics and/or other sufficiently strong, and preferably light weight material, in any combination. In addition, as can be seen, the v-brace member 20 is preferably made of a single piece aluminum tube which has been radially bent into a v-shape. This single piece aluminum tube construction provides additional structural rigidity and strength to the v-brace member 20 and also to the table legs 14 which they support. In other embodiments however, these components may be made from a different material and the v-brace member 20 may be constructed from two or more pieces. Moreover, in the present embodiment as most clearly shown in FIG. 5, the pivoting member 24 is a molded component member adapted to be affixed to an end of the central brace member 22 such as by plug member 27. The pivoting member 24 also has a through hole 25 which is sized to receive and pivotably retain the v-brace member 20. Of course, in other alternative embodiments, the central brace member 22 and the v-brace member may be pivotally attached by different pivoting means such as a via a hinge and/or hinge pin.

The massage table 10 accordance with the preferred embodiment of the present invention also includes a central cable 28 extending between the pair of braces 18 which is adapted to cause the outswinging of the plurality of table legs 14 into an extended position when the at least two table top sections 12 and 12' are unfolded. In particular, in the embodiment shown, the central cable 28 extends between the pivoting members 24 of the pair of braces 18 and are attached to the pivoting members 24 as shown in FIG. 5. Because the central cable 28 is of a fixed length and attached to the pivoting members 24 of the pair of braces 18, when the at least two table top sections 12 and 12' are unfolded, the central cable 28 causes the pair of braces 18 to be hinged into an operative position shown thereby causing the plurality of table legs 14 to be erected into the operative position. In this manner, the central cable 28 facilitates the setup of the massage table 10 by unfolding the plurality of legs 14 and erecting them automatically when the hingably connected table top sections 12 and 12' are unfolded to a co-planar position. Correspondingly, the central cable 28 also prevents any upward folding of each of the pair of braces 18 when the table top sections 12 and 12' are unfolded to a co-planar position thereby preventing the plurality of table legs 14 from collapsing when the massage table 10 is being used.

Figure 6:
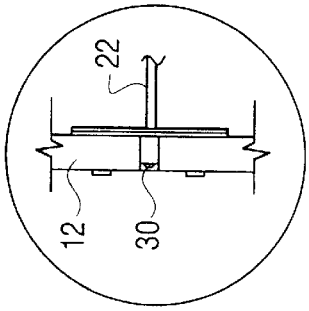
FIG. 6 is an enlarged view of Area 6 of the massage table shown in FIG. 4.
Figure 4:
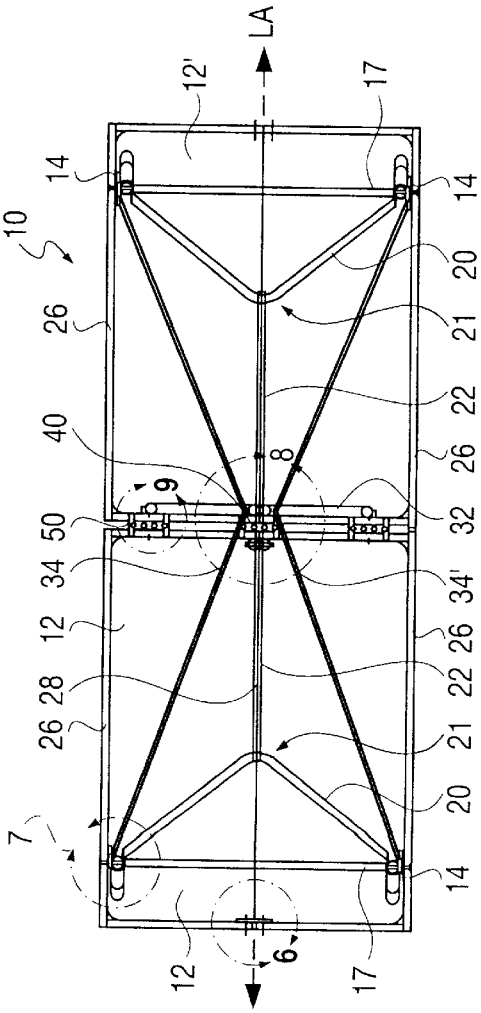
FIG. 4 is a view of the underside of the massage table shown in FIG. 1.

As can also be seen in FIGS. 4 and 6, the central cable 28 also extends from the pivoting members 24 to the table top sections 12 and 12' to prevent the over-displacement of the pivoting members 24. In this regard, an end of the central cable 28 is fixedly attached to the table top section 12 by a retaining member 30 as most clearly shown in FIG. 6. Thus, when the pair of braces 18 are hinged into an operative position, the central cable 28 is tensioned between the pivoting members 24 and the table top sections 12 and 12' thereby preventing the over-displacement of the pivoting members 24 so as to maintain the operative positions of the pair of braces 18, i.e. the central brace member 22 and the brace member 20. In the preferred embodiment, the central cable 28 shown is a single piece cable attached to the pivoting members 24 at intermediary portions of the cable as shown in FIG. 5.

Of course, while the details of the central cable 28 and its attachment in the preferred embodiment is discussed above, the present invention is not limited thereto. For instance, while in the illustrated embodiment, the central cable 28 is attached to the pivoting members 24, in other embodiments, the central cable 28 may also be attached at locations on the braces 18 which is slightly offset from the pivoting members 24. However, attachment of the central cable 28 at the pivoting members 24 is preferred since it minimizes the forces required to hinge the pair of braces 18 into an operative position. In addition, whereas the central cable 28 itself is used to prevent the over-displacement of the pivoting members 24, other means may also be used such as a displacement limiting flange or other mechanisms. Moreover, the central cable 28 need not be a single unitary cable but instead, may be separate cables attached between the pivoting members 24 and between the pivoting members 24 and the table top sections 12 and 12'. However, the use of a single unitary cable is preferred since this allows the minimization of material and assembly costs as well as ensuring compact and simple packaging of the components.

As shown in FIGS. 1–4, the set up and rigidifying mechanism 16 in the illustrated preferred embodiment of the collapsible, foldable massage table 10, further includes a truss member 32 that extends downwardly from at least one of the two table top sections 12 and 12'. As can be most clearly seen in FIG. 2, the truss member 32 is also v-shaped such that it converges away from the edges 26 of the massage table to an end 33 thereby providing the massage practitioner with easy accessability to the area underneath the massage table 10. A midportion of the central cable 28 may be attached to the end 33 of the truss member 32 via a crimped retainer (not shown) so that better management of the central cable 28 and hinging of the pair of braces 18 into an operative position are attained. Again, the truss member 32 shown may be made of an aluminum tube or other materials such as wood, composites and/or plastics.

Figure 7:
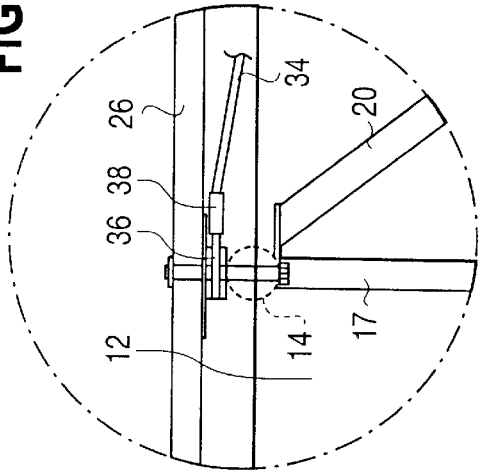
FIG. 7 is an enlarged view of Area 7 of the massage table shown in FIG. 4

Additionally, as most clearly illustrated in FIG. 4, the set up and rigidifying mechanism 16 further includes a first reinforcing cable 34 and a second reinforcing cable 34' that extend from a comer of one table top section 12 to the corner of the other table top section 12' in the manner shown. The midportions of the first and second reinforcing cables 34 and 34' are fixedly attached to the end 33 of the truss member 32 via crimped retainers (not shown). The mounting of the first reinforcing cable 34 to the comer of the table top section 12 is better illustrated in FIG. 7. As can be seen, the first reinforcing cable 34 is wrapped into a loop around a circular member 36 and affixed using a retainer 38 thereby securing the first reinforcing cable 34 such that it increases the structural rigidity and load carrying capacity of the massage table 10. The second reinforcing cable 34' is also attached in a similar manner to further increase the structural rigidity and load carrying capacity of the massage table 10. In this regard, as weight is placed upon the surface of the table, the weight is transferred to the truss member 32. Because the first and second reinforcing cables 34 and 34' are fixedly attached to the end 33 of the truss member 32, any tendency to downwardly displace the truss member 32 is resisted by the tensioning of the first and second reinforcing cables 34 and 34' as well as the pair of braces 18. Thus, the illustrated massage table 10 having the first and second reinforcing cables 34 and 34' have substantially increased load carrying capacity as compared to a massage table which does not incorporate such reinforcing cables. In laboratory testing, the present inventors have found that the presently illustrated preferred embodiment of the massage table 10 with the first and second reinforcing cables 34 and 34' exhibits substantially increased load carrying capacity over the prior art tables while at the same time, being lighter in weight and more economical in cost.

Moreover, in accordance with the illustrated embodiment, the first and second reinforcing cables 34 and 34' do not substantially impede the massage practitioner's access to the area underneath the massage table 10. In particular, as can be clearly seen in FIGS. 1 and 4, the first and second reinforcing cables 34 and 34' converge together and away from the edges 26 of the massage table as they downwardly approach the end 33 of the truss member 32 to which they are attached. This provides the massage practitioner with easy accessability to the area underneath the massage table 10 at the midportion of the unfolded table. As shown in FIG. 4, the first and second reinforcing cables 34 and 34' are positioned more closely to the edges 26 of the massage table closer to the corners of the table top sections 12 and 12' where they are also attached. However, as most clearly shown in FIG. 2, because the reinforcing cables are positioned progressively closer to the table top sections 12 and 12' as the comers of the table top sections are approached, the cables do not substantially impede the access to the area underneath the massage table 10. Thus, in the above described manner, the first and second reinforcing cables 34 and 34' in accordance with the illustrated embodiment of the massage table add to the load carrying capacity of the massage table 10 while providing minimal negative impact to the massage practitioner's access to the area underneath the massage table 10.

Figure 8A:
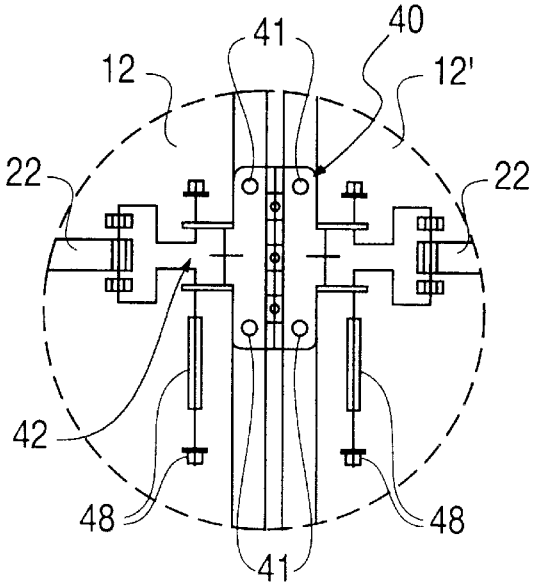
FIG. 8A is an enlarged exploded view of Area 8 of the massage table shown in FIG. 4.
Figure 8B:
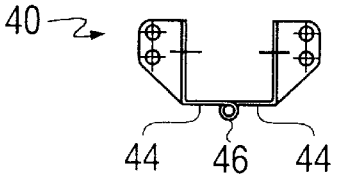
FIG. 8B is a side view of the integral hinge shown in FIG. 8A.

In accordance with the illustrated embodiment of the present invention, the table top sections 12 and 12' are hingably attached together by an optional integral hinge 40 and optional integral hinges 50 which are discussed in further detail herein below. In particular, the integral hinge 40 which is most clearly shown in FIGS. 8A and 8B, includes a plurality of brackets 44 which are attached to the table top sections 12 and 12' via fasteners 41. The plurality of brackets 44 are hingably joined together by a hinge 46 that allow the table top sections 12 and 12' to be pivoted relative to one another. The integral hinge 40 also includes a receiving area 42 integrally formed from the plurality of brackets 44 for receiving and hingably attaching an end of the central brace member 22 via fasteners 48. Thus, the integral hinge 40 combines the functions of a conventional hinge with the functions of a brace attachment in a single, lighter, stronger and more compact component. In addition, because the central brace member 22 is directly connected to the integral hinge 40 via the receiving area 42 and the fasteners 48, the central brace member 22 gives direct support to forces exerted on the integral hinge 40 thereby providing increased strength to the attachment of the two table top sections 12 and 12' and increased structural stability and rigidity of the present massage table 10.

Figure 9A:
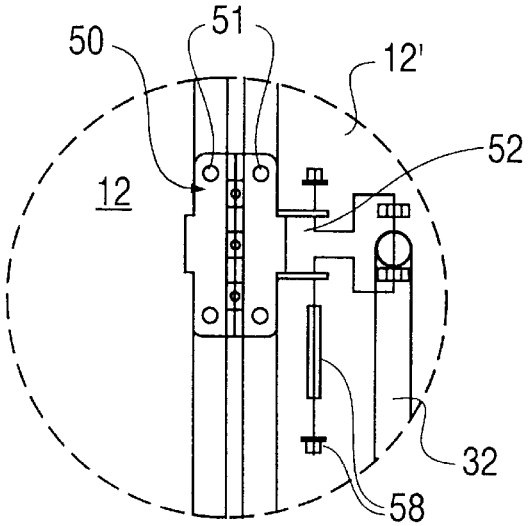
FIG. 9A is an enlarged exploded view of Area 9 of the massage table shown in FIG. 4.
Figure 9B:
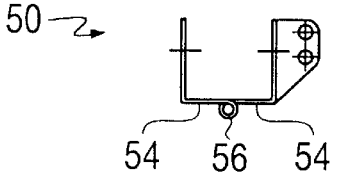
FIG. 9B is a side view of the integral hinge shown in FIG. 9A.

Similarly, the integral hinge 50 which is most clearly shown in FIGS. 9A and 9B, includes a plurality of brackets 54 which are attached to the table top sections 12 and 12' via fasteners 51. The plurality of brackets 54 are hingably joined together by a hinge 56 that allow the table top sections 12 and 12' to be pivoted relative to one another. The integral hinge 50 also includes a receiving area 52 integrally formed from one of the plurality of brackets 54 for receiving and hingably attaching an end of the truss member 32 via fasteners 58. Thus, the integral hinge 50 combines the functions of a conventional hinge with the functions of a truss attachment in a single, lighter, stronger and more compact component.

As previously noted, the above discussed massage table 10 is only one preferred embodiment of the present invention and the present invention should not be construed to be limited to the embodiment discussed. For instance, it should be recognized that the truss member 32, the first and second reinforcing cables 28 and 28' and/or the integral hinges 40 and 50 may or may not be provided in alternative embodiments of the present invention. Furthermore, as also noted previously, the specific details discussed relative to the v-brace member, pivoting members 24 and the mechanisms for attaching the cable need not be strictly adhered to and modifications may be made. Moreover, additional features which are known in the art may also be provided. For instance, a face hole, a carrying handle and a pair of closing latches (all not shown) which are all known in the art may also be provided on the massage table 10 in accordance with the present invention to fuirther enhance the functionality and portability of the massage table 10.

From the foregoing, it should now be apparent how the present invention provides an improved collapsible, foldable massage table which is highly portable, light weight and easy to set up and collapse and is also structurally rigid and stable even under heavy loads. It should now also be apparent how the present invention provides a collapsible, foldable massage table which provides significant reduction in weight and cost over prior art massage tables while providing improved rigidity and stability, even under heavy loads. Moreover, the massage table in accordance with the present invention provides significantly improved accessibility to the space underneath the massage table thereby improving the utility and desirability of the massage table.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications which are encompassed by the appended claims.

We claim:

1. A collapsible, foldable table comprising:

at least two table top sections, at least one hinge connecting said table top sections to allow said at least two table top sections to be moved between a working configuration where said at least two table top sections are co-planar and a collapsed configuration where said at least two table top sections are folded into a substantially parallel orientation;

a plurality of table legs rotatably attached to said at least two table top sections; and set up and rigidifying means for outswinging said plurality of table legs into an extended position as said at least two table top sections are unfolded and for maintaining said at least two table top sections in their co-planar position even when subjected to substantial forces, said set up and rigidifying means including a pair of bracing means for supporting said plurality of table legs in their said extended position when said pair of bracing means are moved to an operative position, at least one of said pair of bracing means including a v-brace member having two ends and a corner end, each of said two ends being pivotally connected to at least one of said plurality of table legs, a central brace member substantially aligned with a longitudinal axis of said collapsible, foldable table, said central brace member having two ends, one of said ends being pivotally connected to one of said at least two table top sections, and a pivoting means for pivotally connecting said corner end of said v-brace member to other of said two ends of said central brace member; and a central cable extending between said pair ofbracing means, said central cable being attached to at least one of said v-brace member, said central brace member and said pivoting means to thereby cause the outswinging of said plurality of table legs into an extended position when said at least two table top sections are unfolded.

2. A collapsible, foldable table of claim 1, wherein both bracing means of said pair of bracing means includes a v-brace member, a central brace member, and a pivoting means for pivotally connecting said v-brace member to said central brace member.

3. A collapsible, foldable table of claim 2, wherein said central cable extends between said pivoting means of said pair of bracing means.

4. A collapsible, foldable table of claim 2, wherein said set up and rigidifying means further comprises a truss member that extends from at least one of said at least two table top sections, a midportion of said central cable being attached to an end of said truss member.

5. A collapsible, foldable table of claim 4, wherein said central cable further extends from said pivoting means of said pair of bracing means to said at least two table top sections thereby preventing over displacement of said pivoting means.

6. A collapsible, folding table of claim 5, wherein said pivoting means for each of said pair of bracing means is a molded member adapted to be affixed to an end of said central brace member, said pivoting means also having a through hole sized to receive said v-brace member.

7. A collapsible, foldable table of claim 1, wherein said setup and rigidifying means further comprises a truss member having an end that extends from at least one of said at least two table top sections.

8. A collapsible, foldable table of claim 7, wherein a midportion of said central cable is attached to an end of said truss member.

9. A collapsible, foldable table of claim 7, wherein said set up and rigidifying means further comprises at least one reinforcing cable which is fixedly attached to at least one of said at least two table top sections and to said end of said truss member.

10. A collapsible, foldable table of claim 9, wherein said at least one reinforcing cable is fixedly attached to said at least two table top sections, a midportion of said at least one reinforcing cable being fixedly attached to said end of said truss member.

11. A collapsible, foldable table of claim 10, wherein said at least one reinforcing cable is a first reinforcing cable and a second reinforcing cable, said first and said second reinforcing cables each extending from one of said at least two table top sections to the other of said at least two table top sections, midportions of said first and second reinforcing cables being fixedly attached to said end of said truss member.

12. A collapsible, foldable table of claim 7, wherein said at least one hinge connecting said table top sections includes an integral truss attaching means for hingably attaching said truss member.

13. A collapsible, foldable table of claim 12, wherein said at least one hinge connecting said table top sections comprises:

a plurality of brackets for attachment to said table top sections, said plurality of brackets being hingably joined together to allow said table top sections to be pivoted relative to one another; and a receiving means integrally formed from at least one of said plurality of brackets for receiving and hingably attaching an end of said truss member.

14. A collapsible, foldable table of claim 1, wherein said at least one hinge connecting said table top sections includes an integral brace attaching means for hingably attaching said central brace member.

15. A collapsible, foldable table of claim 14, wherein said at least one hinge connecting said table top sections comprises:

a plurality of brackets for attachment to said table top sections, said plurality of brackets being hingably joined together to allow said table top sections to be pivoted relative to one another; and, a receiving means integrally formed from at least one of said plurality of brackets for receiving and hingably attaching an end of said central brace member.

16. A collapsible, folding table of claim 1, wherein said pivoting means is a molded pivoting member adapted to be affixed to an end of said central brace member, said pivoting means also having a through hole sized to receive and pivotably retain said v-brace member.

17. A collapsible, folding table of claim 1, wherein said pivoting means includes a hinge pin that hinges said central brace member and said v-brace member together.

18. A collapsible, foldable table comprising:

at least two table top sections, at least one hinge connecting said table top sections to allow said at least two table top sections to be moved between a working configuration where said at least two table top sections are co-planar and a collapsed configuration where said at least two table top sections are folded into a substantially parallel orientation;

a plurality of table legs rotatably attached to said at least two table top sections; and set up and rigidifying means for outswinging said plurality of table legs into an extended position as said at least two table top sections are unfolded and for maintaining said table top sections in their co-planar position even when subjected to substantial forces, said set up and rigidifying means including a pair of bracing means for supporting said plurality of table legs in their said extended position when said pair of bracing means are moved to an operative position, each of said pair of bracing means including a v-brace member having two ends and a corner end, each of said two ends being pivotally connected to at least one of said plurality of table legs, a central brace member substantially aligned with a longitudinal axis of said collapsible, foldable table, said central brace member having two ends, one of said ends being pivotally connected to one of said at least two table top sections, and a pivoting means for pivotally connecting said corner end of said v-brace member to other of said two ends of said central brace member;

a truss member that extends from at least one of said at least two table top sections; and a central cable adapted to cause the outswinging of said plurality of table legs into an extended position when said at least two table top sections are unfolded, said central cable being attached to at least one of said v-brace member, said central brace member and said pivoting means and extending between said pair of bracing means, a midportion of said central cable being attached to an end of said truss member.

19. A collapsible, foldable table of claim 18, wherein said central cable further extends from each of said pivoting means of said pair of bracing means to said at least two table top sections thereby preventing over displacement of said pivoting means.

20. A collapsible, foldable table of claim 18, wherein said set up and rigidifying means further comprises at least one reinforcing cable which is fixedly attached to at least one of said at least two table top sections and said end of said truss member.

21. A collapsible, foldable table of claim 20, wherein said at least one reinforcing cable is a first reinforcing truss cable and a second reinforcing cable, said first and said second reinforcing truss cables each extending from one of said at least two table top sections to the other of said at least two table top sections, midportions of said first and second reinforcing cables being fixedly attached to said end of said truss member.

22. A collapsible, folding table of claim 18, wherein said leg includes a length adjustable means for adjusting the height of said table.

* * * * *